United States Patent [19]

Walker

[11] 4,114,528

[45] Sep. 19, 1978

[54] APPARATUS FOR WEB CALIPER CONTROL

[75] Inventor: Peter J. Walker, Pointe Claire, Canada

[73] Assignee: Midland-Ross Corporation, Cleveland, Mich.

[21] Appl. No.: 663,159

[22] Filed: Mar. 2, 1976

[51] Int. Cl.[2] ..... B30B 15/34; B30B 3/04

[52] U.S. Cl. ..... 100/47; 100/93 RP; 100/162 B; 100/170; 162/206; 29/116 AD; 165/30

[58] Field of Search ..... 100/93 RP, 162 B, 47, 100/170, 168; 165/30, 89, 120; 72/16; 29/116 AD; 236/74 R; 162/206

[56] References Cited

U.S. PATENT DOCUMENTS

| | | | |
|---|---|---|---|
| 1,253,298 | 1/1918 | Temple et al. | 100/93 RP |
| 3,177,799 | 4/1965 | Justus et al. | 100/93 RP |
| 3,203,678 | 8/1965 | Sawyer et a. | 165/30 X |
| 3,266,561 | 8/1966 | Beachler et al. | 100/162 B |
| 3,770,578 | 11/1973 | Spurrell | 162/206 |

*Primary Examiner*—Peter Feldman
*Attorney, Agent, or Firm*—Woodrow W. Portz

[57] ABSTRACT

Disclosed is an apparatus for controlling the caliper of a web, such as a continuous paper sheet issuing from a nip of a plural-roll device, such as a calender. One or more rolls of the device is subjected to a multiplicity of air jets issuing substantially at constant flow rates but at temperatures which may vary as desired from nozzles spaced lengthwise of the roll.

10 Claims, 8 Drawing Figures

FIG. 1
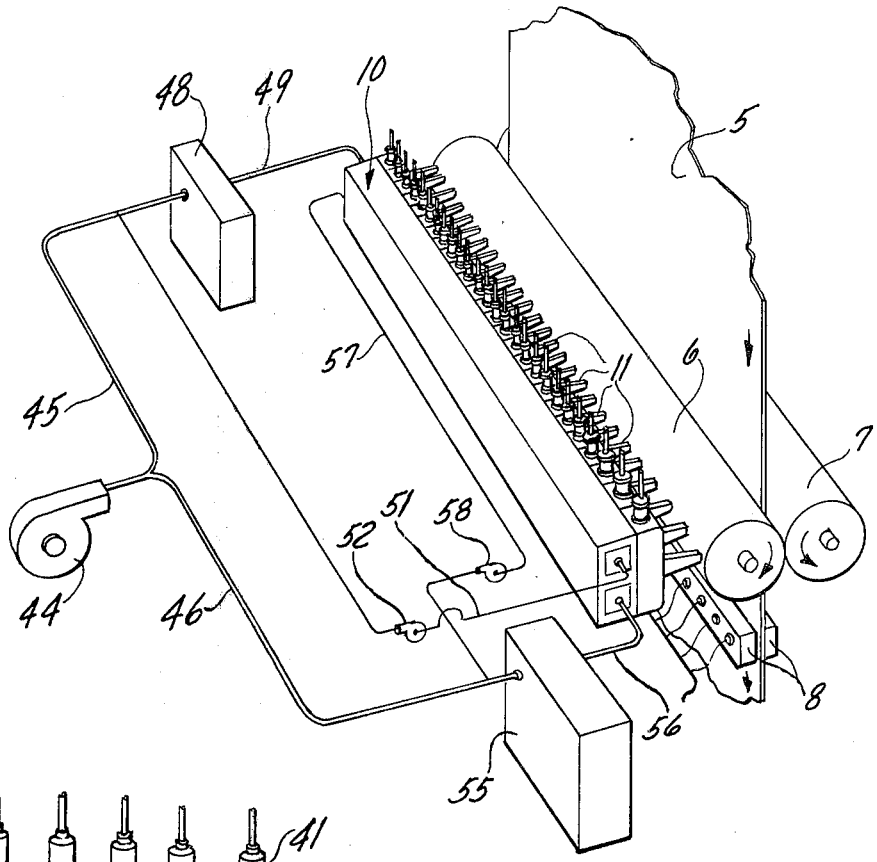
FIG. 2
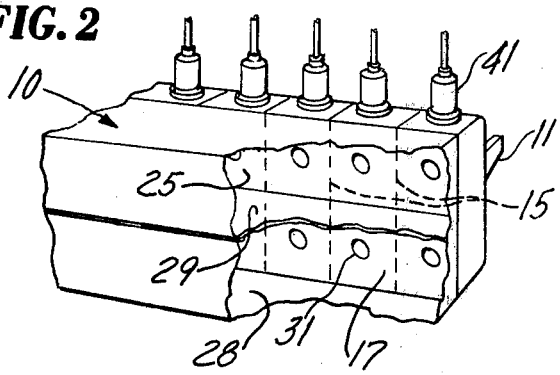
FIG. 3
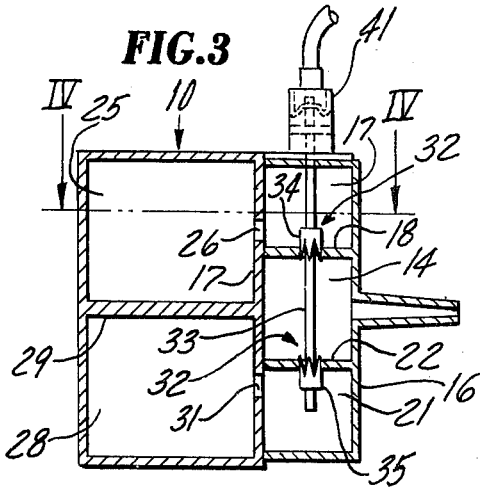
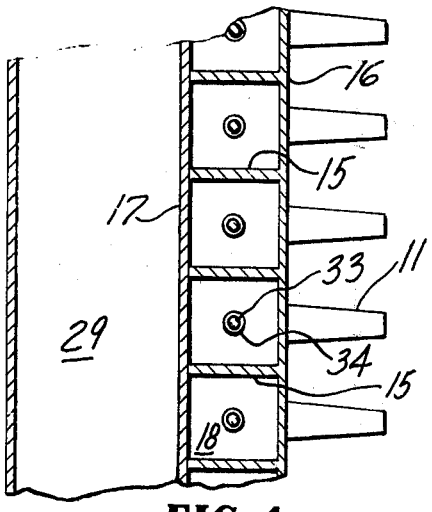
FIG. 4
FIG. 5
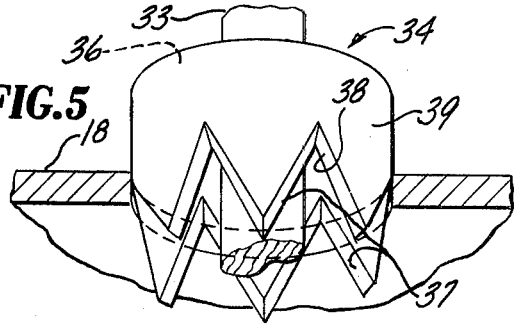

APPARATUS FOR WEB CALIPER CONTROL

BACKGROUND OF THE INVENTION

In following the teachings of the prior art, e.g., Spurrell in U.S. Pat. No. 3,770,578 or Goyette in U.S. Pat. No. 2,981,175 according to which hot or cold air is applied to individual longitudinal sections of a calender roll from a hot air plenum or a cold air plenum in response to variations from the normal thickness of a paper web passing through the calendar, it is now recognized from actual practice that the temperature of the air in the walls of the hot or cold air plenums and associated air supply systems approaches room temperature during periods of little demand for air. Hence, when a caliper correction is required, the nozzles responsible for delivering air at a control temperature discharge air for at least a measurable time period at an improper temperature until the hot or cold air supply system reaches equilibrium with the temperature of air passing through it. Such a mode of operation prevents quick correction of the web thickness and thus achievement of the quality potential of the web product that is possible.

In past practice, control of the caliper by changing the diameter of the calendar roll was affected by impinging hot or cold air on one circumference of the roll and varying by velocity of air impingement to achieve the effect desired. Frequently, however, the roll diameter at each side of the circumference being corrected was unduly disturbed. The remedy was to impinge either cool or hot air, as the case required, on the roll at the sides of the circumference being corrected. The velocity of the air was varied according to the judgment of the operator. According to this earlier practice, air was not applied to the roll except during circumference correction.

Objects of the invention are to provide an apparatus that will enable more precise control in the processing of webs especially webs of paper to desired thicknesses or caliper; to provide apparatuses more responsive to caliper-sensing mechanism; to provide a continuous flow of air at a standard temperature to maintain a uniform circumference along the calender roll and eliminate the need for compensating or correcting air application to the roll at both sides of a target circumference being corrected; and to adopt a method which will require merely changing one variable, i.e., temperature of the air issuing from the nozzles to effect proper circumference correction of the roll along its length for uniform web thickness.

SUMMARY OF THE INVENTION

The present invention is based on the discovery that hot and cold air supplied to a web thickness controlling mechanism associated with a plural-roll calender, is preferably stored in and delivered by plenums, ducts and the like in which the hot and cold air is normally moving continuously through respective supply systems to separate mixing chambers, one for each nozzle of a manifold of nozzles aligned lengthwise of, but aimed at, a calender roll. The apparatus is arranged for discharging a normal mixture of hot and cold air corresponding to an average or target thickness to which the web is being formed. The apparatus is responsive to deviations of the target thickness by causing mixtures of mostly hot air or mostly cold air, as the occasion may demand, to pass through the nozzles and impinge on a target portion of the roll needing change of circumference.

Each nozzle is connected directly to, and supplied by, a mixing chamber connected to a hot air plenum and a cold air plenum through proportioning apparatus, such as a proportioning valve. In order that the proportioning of hot and cold air to any mixing chamber may be accomplished by a relatively simple device, the plenums are preferably maintained at respective uniform temperatures and a common pressure. By this arrangement, all nozzles of a manifold are continuously discharging air at substantially uniform flow rates with the temperature of the air issuing from each individual nozzle being varied in temperature as a caliper sensing device indicates a variation in the thickness of a corresponding portion of the web from its intended norm.

BRIEF DESCRIPTION OF THE DRAWING

FIG. 1 is a perspective diagrammatic view of an air supply system for controlling the circumferential size of a calender roll at a multiplicity of circumferences spaced uniformly along its length for the purpose of controlling web thickness.

FIG. 2 is a fragmentary perspective view with portions broken away of an air-dispensing manifold or assembly shown in FIG. 1 which includes hot and cold headers, a plurality of air nozzles, and a corresponding plurality of mixing chambers and valve mechanisms associated therewith.

FIG. 3 is a transverse cross sectional view of the assembly shown in FIG. 2 illustrating an arrangement thereof for mixing and proportioning hot and cold air.

FIG. 4 is a fragmentary view in cross section taken along line IV—IV of FIG. 3.

FIG. 5 is a fragmentary perspective view in section of a valve construction as employed in the apparatus of FIGS. 1 to 4.

DESCRIPTION OF THE PREFERRED EMBODIMENTS

Figure 8:
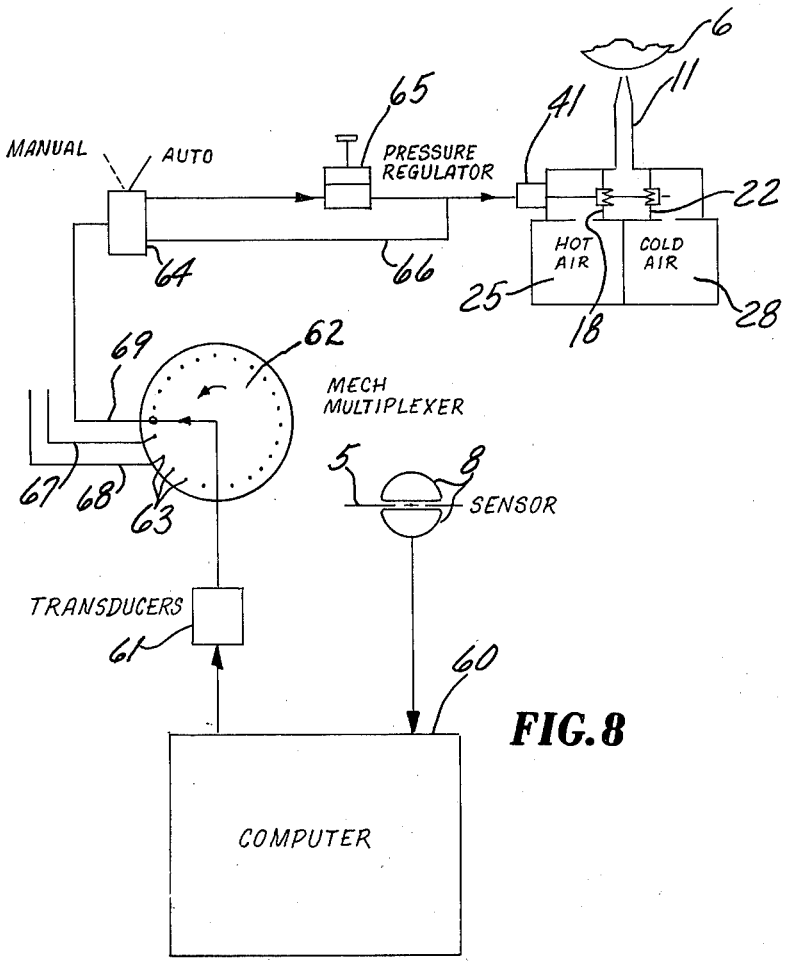
FIG. 8 is a diagram of an entire system operating in connection with a calender roll to control web thickness incorporating the fluid supply system illustrated by FIG. 1; and various other thickness sensor, transducer computer and controller components.

FIG. 1 illustrates schematically elements of the fluid supplying system functioning as a sub-assembly of the overall automatic web thickness control system illustrated in FIG. 8. FIG. 1 illustrates that a web 5 passes through calender rolls 6,7 and through a web-thickness sensing device 8. In accordance with the embodiment as illustrated as FIGS. 1, 2 and 3, a fluid (usually air) dispensing device 10 is arranged lengthwise of the calender roll 6 with nozzles 11 thereof projecting in a substantially radial direction in respect to the axis of the roll 6. The nozzles 11 are uniformly spaced along the length of the roll 6 to enable any fluid issuing therefrom to effect by temperature changes of the diameter of the corresponding portions of the cylindrical surface of the roll 6 revolving within the ejection pattern of each nozzle. The dispenser 10 comprises a plurality of mixing chambers 14, each of which has as its outlet, one of the nozzles 11. The chambers 14 are separated one from the other by vertical walls 15 extending between the outer vertical wall 16 and an inner vertical wall 17.

For the particular valve mechanism shown, the chamber 14 is separated along its top portion from a hot intermediate or secondary chamber 17 by a horizontal wall or orifice plate 18, and along its bottom portion from a cold intermediate or secondary chamber 21 by a horizontal wall or orifice plate 22.

The dispenser 10 further comprises a hot header 25 extending the full length of the dispenser and communicating with the various hot air secondary chambers 17 through a plurality of apertures 26, one from each secondary chamber 17. A cold air header 28 separated from the hot air header by a wall 29 has a plurality of apertures 31, of which each opens into one of the cold air secondary chambers 21.

The object of releasing hot and cold air into the mixing chamber 14 is to control the flow from the secondary chambers to the mixing chamber in such a manner that a constant volume is supplied thereto regardless of the ratio of hot air to the cold air discharged thereinto from the secondary chambers. In principle then, such operation requires that the quantity of cold air entering the mixing chamber be reduced in accordance with an increase in the quantity of hot air entering from the chamber 17 to obtain an increase in the temperature of the air discharged from the nozzle. When cooler air is desired from the nozzle 11, the flow of cooler air from the mixing chamber 21 is increased in correspondence with reduction of hot air from the secondary chamber 17.

Adjustment of the temperature of the air discharged from the nozzle 11 is effected in accordance with one embodiment by valve mechanism of the type shown most plainly in FIGS. 3 and 5 wherein the walls 18 and 22 are coaxially apertured to receive an assembly 32 comprising a longitudinally reciprocable valve shaft 33 and a pair of cylindrical closed end valve elements 34,35 supported within apertures therefor in the walls 18,22, respectively. The valve elements 34,35 are typified by element 34 in FIG. 5 wherein the element comprises a cylindrical sidewall 39 extending from its closed end 36 to define saw teeth 37 tapering away from the closed end. Elements 34,35 are positioned along the rod 33 so that at neutral position portions of the notches 38 between the saw teeth on both elements are exposed within the chambers 17 and 21 so that equal amounts of hot and cold air may flow from chambers 17 and 21, respectively, into the mixing chamber 14. As the valve assembly is moved in one direction or the other, the notches of one element 34,35 or the other, is exposed within the respective adjacent secondary chamber 17 or 21 and correspondingly less of the notches of the other valve element are exposed in its respective adjacent secondary chamber. Even though the assembly is moved to a complete shutoff from one of the secondary chambers, the quantity of air passing through the mixing chamber 14 and outwardly through the nozzle 11 is maintained at substantially constant volume.

As part of the apparatus for automatically individually changing the positions of each valve assembly, the rod 33 terminates in a small fluid operated spring return cylinder piston unit 41. In the practice of the invention being now described, the units 41 are provided with return springs capable of yielding resiliently to pressures in the range of 5 to 30 pounds applied to the units. As it is desired that the units 41 respond to varying signal pressures in an extremely responsive manner, units 41 are preferred in a design which is frictionless as possible. Air cylinders, such as Part No. 421-980-008 manufactured by the Bellofram Corp. of Burlington, Massachusetts providing a stroke length of approximately 1 inch had been found satisfactory for the required valve travel.

As an example of a system for supplying air to the hot and cold air headers 25,28, FIG. 1 depicts a blower 44 which supplies air under pressure to branch lines 45 and 46 leading into hot air and cold air sub-systems, respectively. In supplying hot air to the header 25, air is supplied by line 45 to a heater 48 and thence through line 49 to the hot air header 25. To maintain the header and the air therein at a constant temperature through quiescent periods, the hot air system may include a recirculation line 51 connected with one end of the hot air header and with the inlet portion of line 45 to the heater 48 through which air flow is effected by a recirculation blower 52. In a similar manner, air passes through line 46 to a cooler 55 and thence through line 56 to the cold air header 28. To maintain a uniform temperature in the cold air header, cold air may be recirculated through the cooler and the header by means of a recirculation line 57 and a recirculating blower 58 in this line.

As shown, the various nozzles 11 are aimed in a radial direction against the periphery of the calender roll 6 which, in cooperation with calender roll 7, advances the web 5 in the downward direction indicated by the arrows as the web leaves the calender rolls it passes through a scanning device 8 which by electronic means, such as manufactured by the Measurex Corp. of Cupertino, California, continuously scans the entire width of the web in a back and forth pattern to collect web-thickness information transmitted into a computer 60 of known design. The computer in turn issues electrical signals to an electropneumatic transducer 61. Pneumatic signals therefrom are received by a mechanical multiplexer 62 in synchronism with the scanning device 8. The multiplexer 62 provides a plurality of control points 63 which individually connect with corresponding pneumatically operated selector valves typified by valve 64 which transmits a modulated pressure signal through the pressure regulator 65 to the air cylinder unit 41 for proper adjustment of the valve assembly 32 with respect to valve orifice plates 18 and 22. Line 66 bypasses the pressure regulator for the purpose of permitting escape of air from the cylinder 41 through the four-way selector valve 64 during settings of the valve mechanism requiring reduction of pressure in the unit 41. Air lines 67 and 68 are merely of lines leading to other apparatus similar to that connected with line 69 for serving each nozzle and valve assembly.

Figure 6:
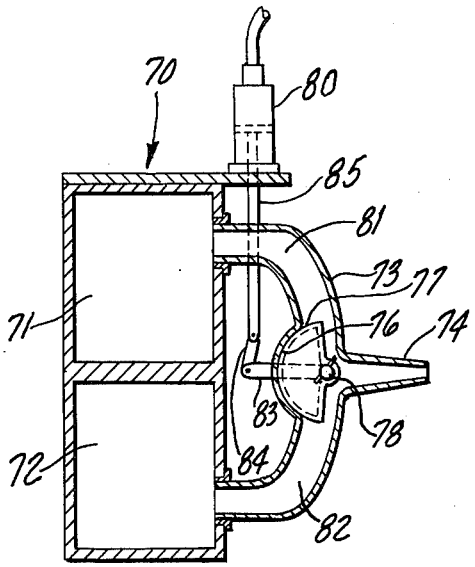
FIG. 6 is a transverse cross section of a modified air distribution assembly.

FIG. 6 illustrates a modified air dispenser 70 comprising walls defining hot and cold air chambers 71 and 72, and a manifold 73 having a nozzle 74. The manifold defines a valve chamber at 76 within which a partly cylindrical valve element 77 is rotatable in opposite angular directions about its fulcrum shaft 78 to increase or decrease the air passing from the hot branch 81 of the manifold into the nozzle 74 while correspondingly decreasing or increasing, respectively, the air passing from the cold branch 82 of the manifold to the nozzle. Automatic operation in proportioning the air passing from the passageways 81,82 is effected through a lever 83 connected by linkage 84 to the reciprocatable push rod 85 of an air cylinder 80 which may be similar to air cylinders 41 of the previously described embodiment. Automatic control of the hot and cold air mixture entering the nozzle 74 may be effected by the apparatus of FIG. 8 as hereinbefore described with respect to dispenser 10.

Figure 7:
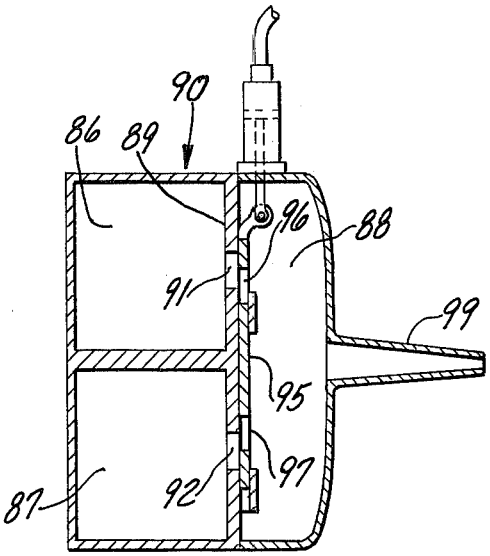
FIG. 7 is a transverse cross section of another modified air distributing assembly.

FIG. 7 schematically sets forth another modified air dispenser 90 comprising walls defining a hot header 86 and a cold header 87 and an individual mixing chamber 88 for each nozzle 99. The mixing chambers are separated from the hot and cold headers by a wall 89 having an aperture 91 through which hot air passes into chamber 88 from the hot header, and an aperture 92 through which cold air passes from the cold header into the mixing chamber. Passage of air from headers 86,87 is regulated by an orifice plate 95 having openings 96,97 therethrough which preferably have equal diameters and diameters that are equal to those of the apertures 91,92. As shown, the openings 96,97 are spaced apart by a distance which is less than the spacing of apertures 91,92 by a difference approximately equal to the diameter of an opening 96 or 97. Consequently, as the orifice plate is moved to vary the passage of air from chambers 86,87, the orifice plate 95 moves to progressively close one opening 91 or 92 while progressively opening the other aperture 92 or 91, respectively. The mixture of hot and cold air thereby received into the mixing chamber 88 passes from the dispenser 90 through its nozzle 99.

What is claimed is:

1. Apparatus in combination with a plural-roll calender for adjusting the thickness of a web passing through the calender comprising:

separate header and source means for hot and cold fluids, and means for maintaining said fluids under uniform pressure and at predetermined respective hot and cold temperatures in respective header means;

a plurality of nozzle means in communication with the header means and spaced along a roll of the calender and oriented toward said roll to direct a mixture of said fluids against longitudinally spaced portions of the roll; and separate valve means associated with each of the nozzle means for proportioning the flow of fluids from the headers for passage through the nozzles, each of the valve means including means which are movable, in unison, for increasing, by a certain amount, the volume of fluid flowing from one of the headers to an associated nozzle means while simultaneously decreasing, by the same amount, the volume of fluid flowing from the other of said headers to said associated nozzle means, so that the volume of fluid flowing from said nozzle means remains constant as the temperature of the fluid is varied.

2. The apparatus of claim 1, which includes a separate mixing chamber disposed between the headers and each of the nozzle means and in which fluids from the headers are mixed for subsequent passage through the nozzle means.

3. The apparatus of claim 2, which includes:

wall means separating the headers and each of the chambers, a pair of orifices in each of the wall means between said headers and a chamber, one orifice connecting each header with a chamber; and wherein the valve means includes:

means for progressively closing one orifice while correspondingly progressively opening the other orifice.

4. The apparatus of claim 3 wherein:

said orifices open into said mixing chamber through a plane surface of said wall means; and said valve means comprises an orifice plate secured slideably against said plane surface and having openings of a greater or lesser spacing than said wall section orifices said plate being movable over said surface to achieve simultaneous opening of one opening and progressively bring one opening into registry with one orifice while progressively moving the other opening out of registry with the other orifice.

5. The apparatus of claim 3 comprising:

manifold means joining with said wall means and each nozzle comprising separate branches contiguous with said orifices and forming a junction adjacent said nozzle, said valve means being positioned in said junction and rotatable therein to progressively close off one branch of said manifold means while opening the other end and vice versa.

6. The apparatus of claim 3 wherein:

said mixing chamber comprises a mixing chamber and a pair of secondary chambers on opposite ends of said mixing chamber, each secondary chamber being located along said wall means so as to be contiguous with one of said orifices, said secondary chambers and the mixing chamber being separated by two end walls having a pair of coaxially aligned apertures, and the valve means includes an elongated shaft extending longitudinally through the apertures, a pair of valve elements mounted coaxially on the shaft and spaced therealong to position one element within one aperture with the other valve element immediately outside the other aperture, so that no fluid passes through said one aperture and fluid may pass through the other aperture or vice versa upon a slight shift of said shaft; and fluid power means for shifting said shaft between the two orifice opening positions of the valve means.

7. The apparatus of claim 1 comprising:

sensing means for registering differences in the thickness from a desired thickness of the web advancing away from said roll at said longitudinally spaced portions of said roll;

transducer and computer means connected with said sensing means;

control means for separately actuating said proportion valve means;

transducer and computer means connected with said sensing means and said control means for translating said differences in thickness into electrical signals for actuating said control means.

8. The apparatus of claim 1 wherein said means for maintaining fluids under uniform pressure and predetermined hot and cold temperature comprises:

a fluid pump;

a fluid heater in downstream line relation with said pump and upstream line relation with said hot fluid header;

a fluid cooler in downstream line relation with said pump and upstream line relation with said hot fluid header;

said pump and said heater being connected by a first supply line and said pump and cooler being connected by a second supply line.

9. The apparatus of claim 7 comprising:

a first fluid recirculation means extending from said hot fluid header to said first line for returning from said header to said heater; and a second recirculation means connected with said cold fluid header and said second line for returning fluid from said cold fluid header to said cooler.

10. The apparatus of claim 6, wherein the valve elements have coaxially aligned cylindrical sidewalls each of which has a pair of opposing ends, the ends of the sidewalls in farthest spaced relation being closed and the ends of the sidewalls in closest spaced relation being serrated and having saw teeth, each of which teeth have sides that converge in the direction of the opposing valve element.

* * * * *